US007548719B2

(12) United States Patent
Ito et al.

(10) Patent No.: US 7,548,719 B2
(45) Date of Patent: Jun. 16, 2009

(54) FIXING UNIT INCLUDING HEAT ROLLER WITH TUBULAR HEATER AND FITTING SURFACE

(75) Inventors: Hiroshi Ito, Osaka (JP); Kunihiko Ishii, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 12/149,370

(22) Filed: Apr. 30, 2008

(65) Prior Publication Data

US 2008/0205949 A1 Aug. 28, 2008

Related U.S. Application Data

(63) Continuation of application No. 11/316,885, filed on Dec. 27, 2005, now Pat. No. 7,386,265.

(30) Foreign Application Priority Data

Dec. 28, 2004 (JP) ..... 2004-379808

(51) Int. Cl.
*G03G 15/20* (2006.01)

(52) U.S. Cl. ..... 399/330; 219/216; 219/470

(58) Field of Classification Search ..... 399/69, 399/122, 330, 334; 219/216, 388, 469, 470, 219/539, 552, 541; 432/224; 445/27
See application file for complete search history.

(56) References Cited

U.S. PATENT DOCUMENTS

| | | | | |
|---|---|---|---|---|
| 3,376,407 | A | | 4/1968 | Wagner |
| 4,768,985 | A | | 9/1988 | Hamai |
| 5,115,119 | A | * | 5/1992 | Adachi et al. ..... 219/469 |
| 6,415,113 | B2 | * | 7/2002 | Kiuchi ..... 399/33 |
| 6,442,360 | B1 | | 8/2002 | Onodera et al. |
| 6,721,518 | B2 | | 4/2004 | Oshida et al. |
| 2004/0256372 | A1 | | 12/2004 | Yoshioka et al. |
| 2004/0264991 | A1 | | 12/2004 | Yoshikawa |

FOREIGN PATENT DOCUMENTS

| | | | |
|---|---|---|---|
| JP | 07254393 | A * | 10/1995 |
| JP | 07311507 | A * | 11/1995 |
| JP | 8-220930 | | 8/1996 |
| JP | 0821758 | A | 8/1996 |
| JP | 08272239 | A * | 10/1996 |
| JP | 08320627 | A | 12/1996 |
| JP | 2004039502 | A * | 2/2004 |

* cited by examiner

*Primary Examiner*—Robert Beatty
(74) *Attorney, Agent, or Firm*—Smith, Gambrell & Russell, LLP

(57) ABSTRACT

A fixing unit includes: a casing; a heat roller that is rotatably supported and that supplies heat for fixing; and a tubular heater disposed in parallel in the heat roller along an axis thereof. The tubular heater includes a lead wire having a protruding end portion protruding outwardly from an axial end portion thereof. In addition, the tubular heater includes a flat terminal having one face thereof connected and fixed to the protruding end portion. Moreover, a fitting surface for fixing the flat terminal is formed in the casing. The fitting surface is arranged to be flat in an area excluding an area in which the protruding end portion is disposed and is provided with a clearance for storing the protruding end portion. Further, the flat terminal is fixed to the fitting surface with the one face of the flat terminal facing the fitting surface.

10 Claims, 19 Drawing Sheets

FIXING UNIT INCLUDING HEAT ROLLER WITH TUBULAR HEATER AND FITTING SURFACE

CROSS REFERENCE TO RELATED APPLICATION

This application is a continuation of Ser. No. 11/316,885, filed Dec. 27, 2005 now U.S. Pat. No. 7,386,265 and which is being incorporated in its entirety herein by reference.

This application is based on Japanese Patent Application No. 2004-379808 filed on Dec. 28, 2004, the contents of which are hereby incorporated by reference.

BACKGROUND OF THE INVENTION

1. Field of the Invention

The present invention relates to a fixing unit, and more specifically, to a fixing unit including a roller provided with two tubular heaters.

2. Description of Related Art

A conventional type of fixing unit of an image forming apparatus, for example, as disclosed in Japanese Patent Application Laid-open No. H8-220930, includes a heat roller for supplying heat for fixing which stores two tubular heaters each composed of a halogen lamp. These two heaters may have respectively different heating areas so as to efficiently support different widths of recording paper. In a manufacturing process of a halogen lamp, during sealing of a silica glass tube, one protruding residual fused tip (tip portion) is inevitably formed on the outer circumferential surface of the silica glass tube. The shape of such a tip portion depends on the shape of a jig used for sealing the glass tube, but is typically substantially columnar (see FIG. 3). The specifications of a halogen lamp for a fixing unit define the height of a tip portion, for example, up to 3 mm maximum for a silica glass tube of 6 mm in diameter. Therefore, the halogen lamp typically has a tip portion of approximately 3 mm in height formed on the outer circumferential surface of a silica glass tube thereof.

Hereinafter, the heater structure and the heater fitting structure of a conventional fixing unit will be described, referring to FIGS. 22 and 23. Two heaters 102 each have flat terminals 124 respectively soldered to lead wires 123 that protrude from both ends of a silica glass tube 121. The flat terminals 124 are respectively fixed with screws to fitting surfaces 141 provided at both longitudinal end walls of a case, not shown, of the fixing unit. The specifications of a typical heater define the orientation of a tip portion 121*a* with respect to the flat terminal 124. For example, as viewed in side views of FIGS. 22 and 23, the height H direction of the tip portion 121*a* is parallel to the width W direction of the flat terminal 124 (see FIG. 22), while the height H direction of the tip portion 121*a* is tilted at 90 degrees with respect to the width W direction of the flat terminal 124 (see FIG. 23). Thus, there are two possible arrangements for the heaters 102. First, the heaters 102 are respectively fixed to the fitting surfaces 141 through the flat terminals 124 so that, as shown in FIG. 22, the tip portions 121*a* of the two heaters 102 are arranged in the same direction with the height direction H thereof parallel to a connection line C1 connecting the centers of the silica glass tubes 121. Alternatively, as shown in FIG. 23, the tip portions 121*a* of the two heaters 102 are arranged with the height direction H thereof orthogonal to the connection line C1 connecting the centers of the silica glass tubes 121 and also in line-symmetry to each other with respect to a center line C2 passing through the center of the heat roller 101.

Therefore, with the arrangement shown in FIG. 22, the two heaters 102 need to be spaced apart at some distance from each other (a distance L between their centers needs to be provided in a sufficient amount) and also the inner diameter of the heat roller 101 needs to be increased so that the tip portions 121*a* do not interfere with the silica glass tubes 121 arranged next thereto, respectively, or with the inner wall of the heat roller 101. Accordingly, the outer diameter D of the heat roller 101 increases, thus resulting in failure to satisfy the demand for space-saving design of parts to follow the recent downsizing trend of image forming apparatuses.

On the other hand, with the arrangement shown in FIG. 23, the heaters 102 can be arranged in some proximity to each other; however, the proximity between the heaters 102 causes a problem that the heaters 102 are likely to make contact with each other to be thereby broken upon their installation.

SUMMARY OF THE INVENTION

It is an object of the present invention to provide a fixing unit with a smaller diameter of a heat roller that incorporates two heaters and also with heater breakage preventive measures.

To achieve the object described above, according to one aspect of the present invention, a fixing unit includes: a heat roller that is rotatably supported and that supplies heat for fixing; and a first and a second tubular heaters that are disposed in parallel in the heat roller along an axis thereof and that each have on an outer circumferential surface thereof one protruding residual fused tip, namely, tip portion. As viewed from a side end surface of the heat roller, the tip portions of the first and second tubular heaters are oriented directly opposite to each other with respect to the connection line connecting centers of the first and second tubular heaters.

In this case, as viewed from the side end surface of the heat roller, the centers of the first and second tubular heaters may be arranged on the center line of the heat roller.

Further, as viewed from the side end surface of the heat roller, a direction in which each of the tip portions of the first and second tubular heaters protrudes may be arranged substantially perpendicularly to the connection line connecting the centers of the first and the second tubular heaters.

As viewed from the side end surface of the heat roller, arranging the tip portions of the first and second tubular heaters so that they respectively tilt toward the tubular heaters adjacent thereto permits a further reduction in the diameter of the heat roller.

DETAILED DESCRIPTION OF PREFERRED EMBODIMENTS

Figure 1:
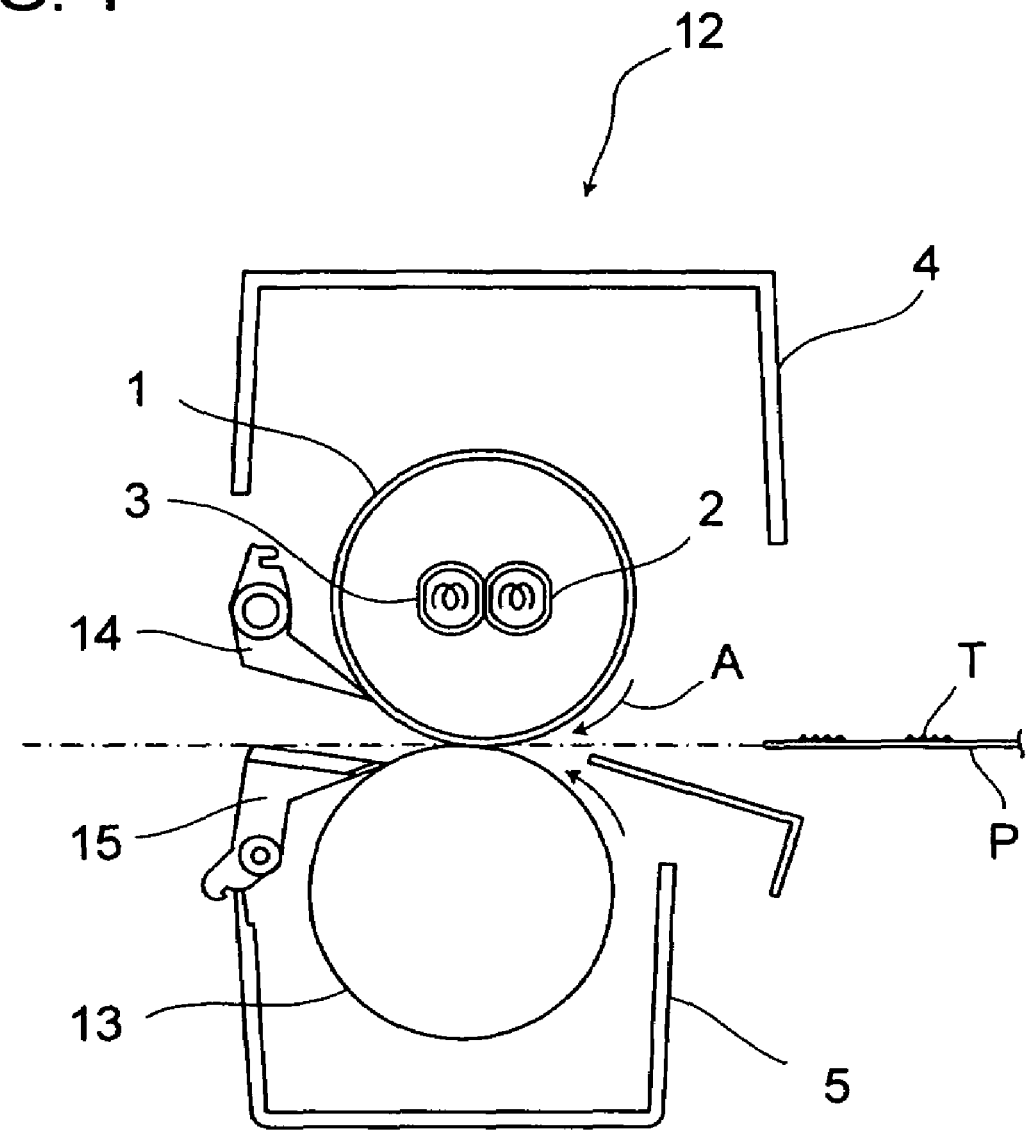
FIG. 1 is a longitudinal sectional view of a fixing unit according to the present invention.
Figure 2:
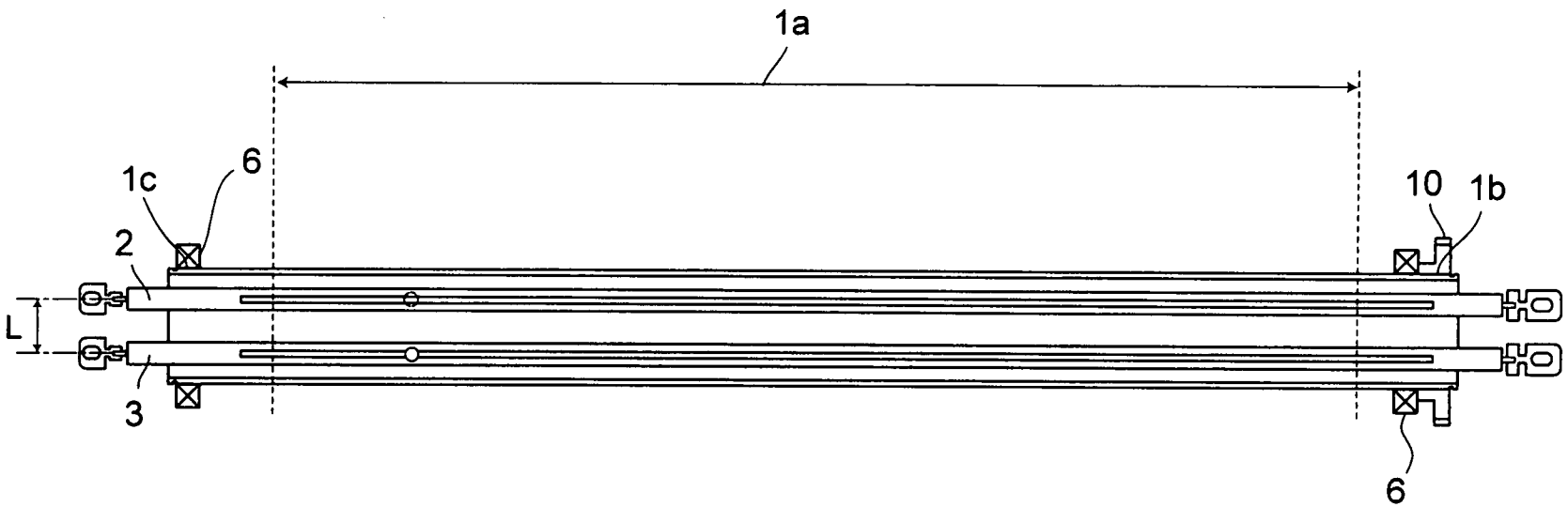
FIG. 2 is a lateral sectional view of a heat roller of the fixing unit according to the invention.

Hereinafter, a description will be given on the preferred embodiments of the invention, with reference to the accompanying drawings. FIG. 1 is a longitudinal sectional view of a fixing unit according to the invention. FIG. 2 is a lateral sectional view of a heat roller of the fixing unit according to the invention.

As shown in FIG. 1, numeral 12 represents an example of the fixing unit according to the invention. A heat roller 1 supplies heat for fixing and also is used as a fixing roller for fixing a toner T on recording paper P. The fixing unit 12 is mainly composed of: in addition to the heat roller 1, a pressure roller 13 for bringing the recording paper P, from the rear surface thereof, into pressure contact with the heat roller 1 to thereby support it; an upper case 4 and a lower case 5 for the fixing unit 12; and the like. The pressure roller 13 is located below the cylindrical heat roller 1 that is rotatably supported by the upper case 4 so as to be driven into rotation in the direction indicated by arrow A, and is rotatably supported by the lower case 5 so as to make pressure contact with this heat roller 1 and rotate. The heat roller 1 is basically formed of metal material as a good heat conductor, such as aluminum, iron, or the like, in the cylindrical shape, with its front surface coated with PTFE, PFA, or the like. As shown in FIG. 2, the heat roller 1 has on both ends thereof shaft portions 1*b* and 1*c* for rotatably supporting the heat roller 1. The pressure roller 13 is formed in the cylindrical shape with a silicon rubber layer thereof provided on a cored bar of iron or the like and also with a surface layer thereof formed into a columnar shape as a release layer of a PFA tube or the like.

As shown in FIG. 2, on the outer circumference of the shaft portions 1*b* and 1*c* of the heat roller 1, sliding bearings 6 are disposed. In particular, to the shaft portion 1*b* at one end of the heat roller 1, a gear 10 for providing the heat roller 1 with rotational drive is fitted outwardly adjacent to the sliding bearing 6.

With the construction described above, as shown in FIG. 1, between the heat roller 1 and the pressure roller 13, the recording paper P with the toner T thereon is delivered as a subject to be fixed, and the recording paper P passes while brought into pressure contact with a paper passage part 1*a* (see FIG. 2) of the heat roller 1, whereby the toner T is fused and fixed onto the recording paper P. Subsequently, the recording paper P is stripped off the heat roller 1 or the pressure roller 13 by a separation claw 14 or 15, to be discharged.

As shown in FIGS. 1 and 2, inside the heat roller 1, two hearts, namely, a first heater 2 and a second heater 3, are disposed for heating this heat roller 1. These first and second heaters 2 and 3 are tubular heaters each composed of a halogen lamp that heats the paper passage part 1*a* of the heat roller 1 up to a predetermined temperature. Hereinafter, a description will be given on a first and a second embodiments of the invention adding some elaboration to the first and second heaters 2 and 3.

First Embodiment

Figure 3:
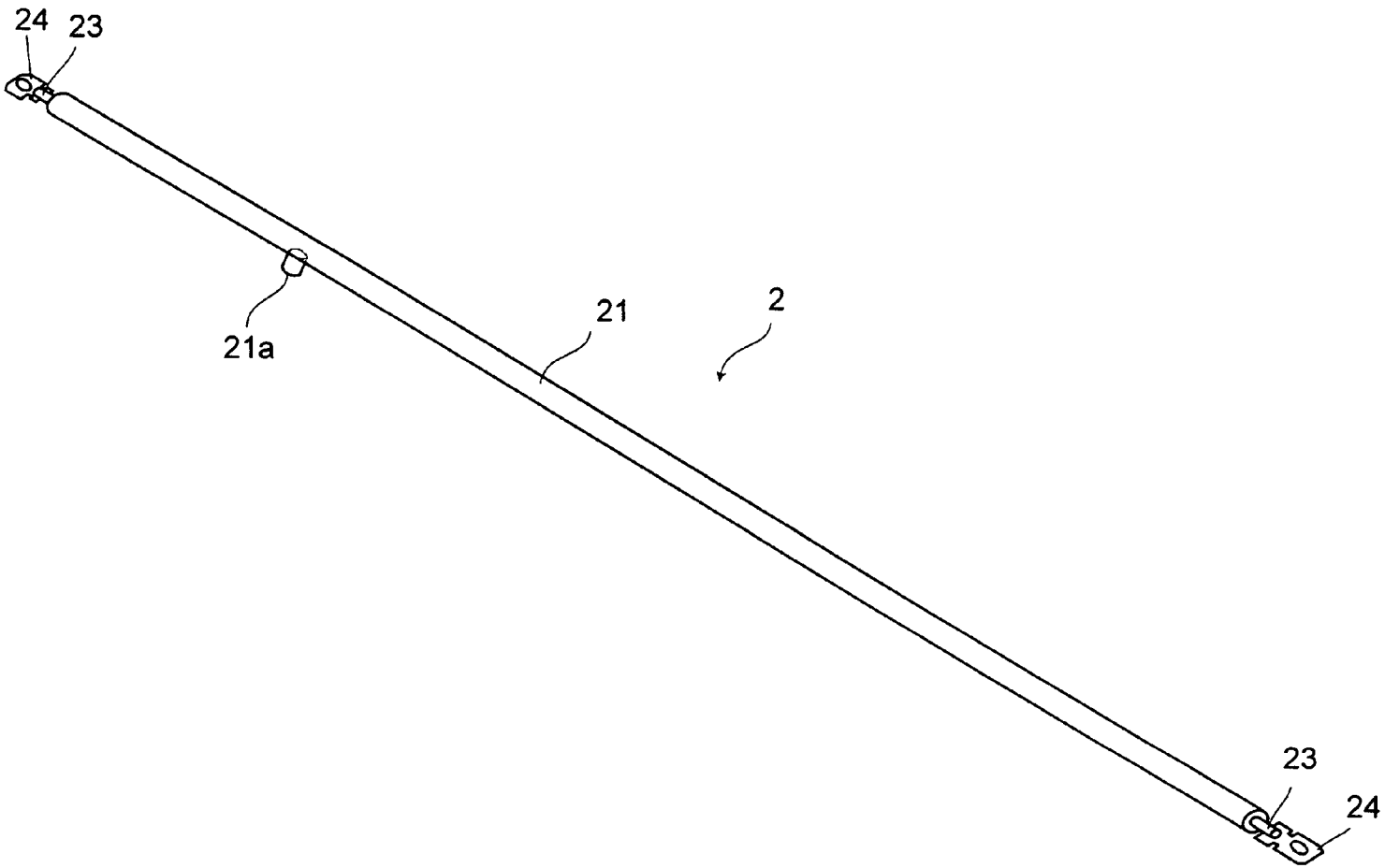
FIG. 3 is a perspective view of a first heater.
Figure 4A:
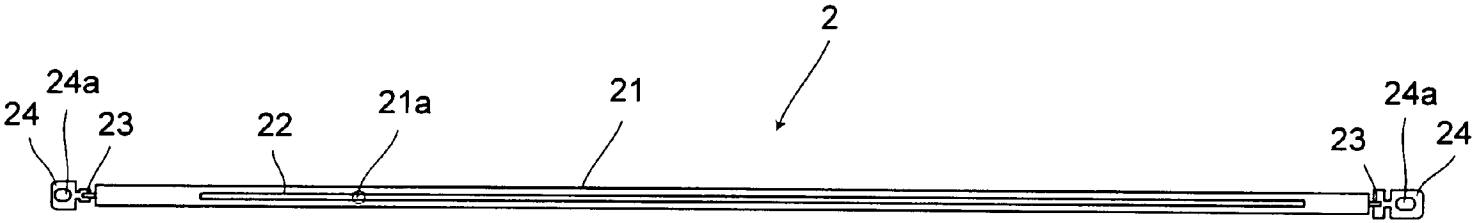
FIG. 4A is a plan view of the first heater.
Figure 4B:
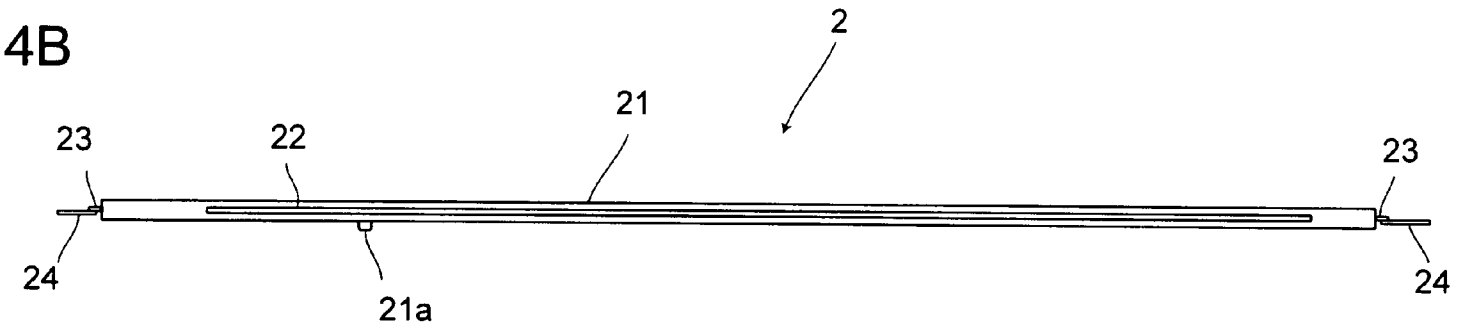
FIG. 4B is an elevation view of the first heater.
Figure 4C:
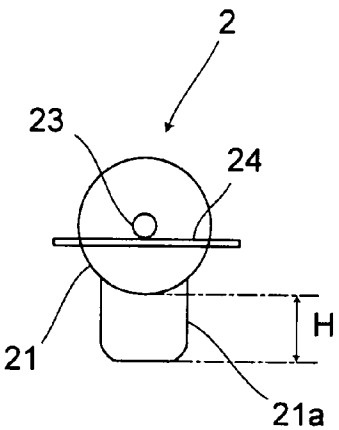
FIG. 4C is an enlarged side view of the first heater.
Figure 23:
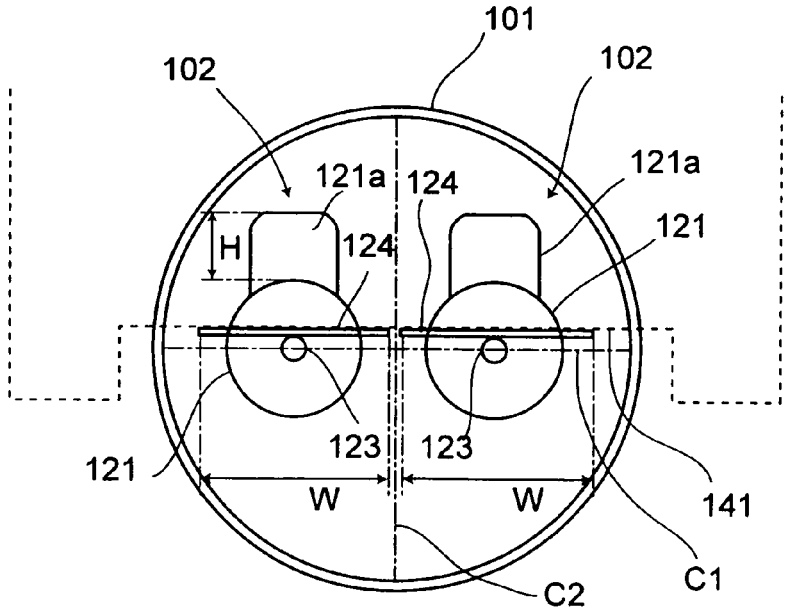
FIG. 23 PRIOR ART
FIG. 23 is a side view showing the positional relationship between heaters and a heat roller in another conventional fixing unit.

First, a description will be given on the first heater 2. FIG. 3 is a perspective view of the first heater. FIG. 4A is a plan view of the first heater, FIG. 4B is an elevation view of the first heater, and FIG. 4C is an enlarged side view of the first heater. As shown in FIGS. 3, 4A, and 4B, as the conventional heater 102 described referring to FIG. 23, the first heater 2 is a halogen lamp constructed by providing a filament 22 of tungsten in a silica glass tube 21 (with a diameter of 6 mm) sealed with halogen gas to form a heat generation part. From one end surface and the other end surface, end portions of lead wires 23 electrically connected to one end and the other end of the filament 22 are respectively protruding. As shown in FIG. 4C, the lead wires 23 are located at the radial center of the silica glass tube 21.

In a manufacturing process of such a halogen lamp, during sealing of the silica glass tube 21, one protruding residual fused tip (tip portion 21*a*) is inevitably formed on the outer circumferential surface of the silica glass tube 21. The shape of such a tip portion 21*a* depends on the shape of a jig used for sealing the glass tube, but is typically substantially columnar as shown in the figure. The specifications of a halogen lamp for a fixing unit define the height H of a tip portion, for example, up to 3 mm maximum for a silica glass tube of 6 mm in diameter. Accordingly, the first heater 2 typically has the tip portion 21*a* of approximately 3 mm in height formed on the outer circumferential surface of the silica glass tube 21 thereof.

As shown in FIG. 4C, to the protruding end portions of the lead wires 23, flat terminals 24 (approximately 8 mm in width) of stainless steel (SUS304) are fitted by soldering or the like so as to be located substantially perpendicularly to the height H direction of the tip portion 21*a* and on the same side as the tip portion 21*a* with respect to the diameter of the silica glass tube 21 (arranged in the order of the lead wires 23, the flat terminals 24, and the tip portion 21*a* in the radial direction). The flat terminals 24 each have a hole 24*a* that permits the first heater 2 to be fixed to a heater fitting surface of the upper case 4 with a screw.

Figure 5:
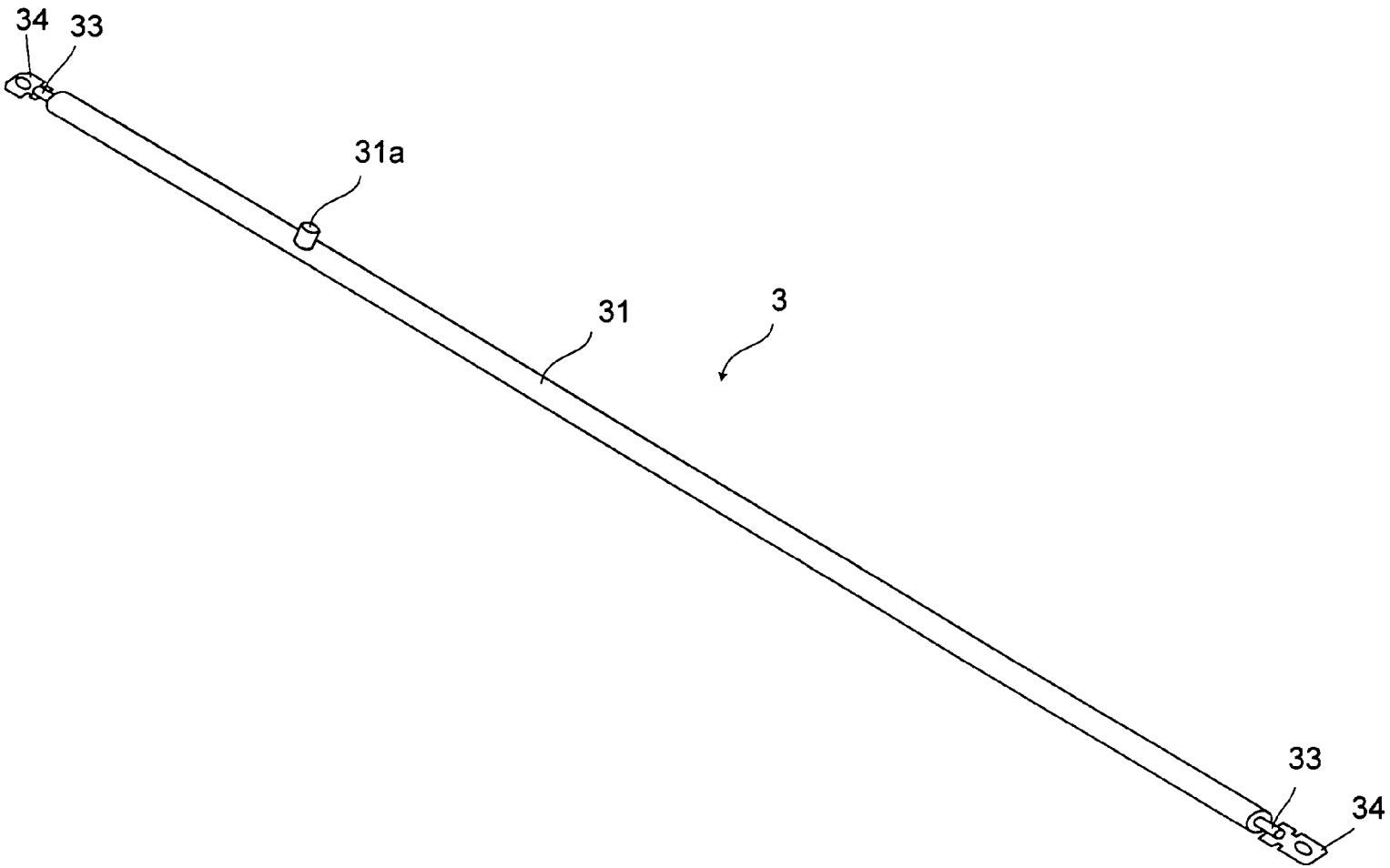
FIG. 5 is a perspective view of a second heater.
Figure 6A:
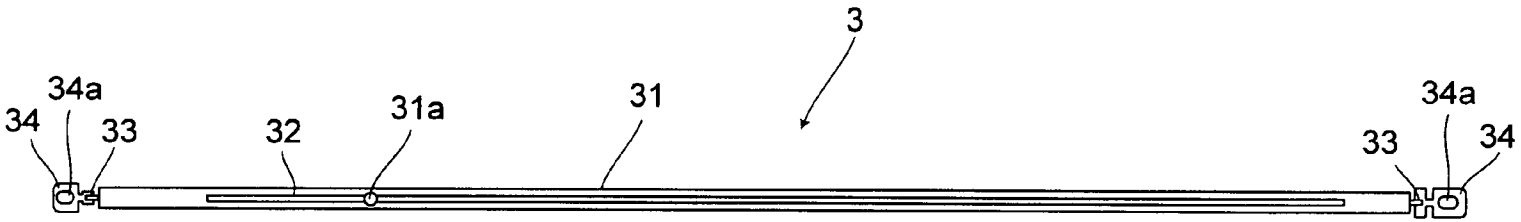
FIG. 6A is a plan view of the second heater.
Figure 6B:
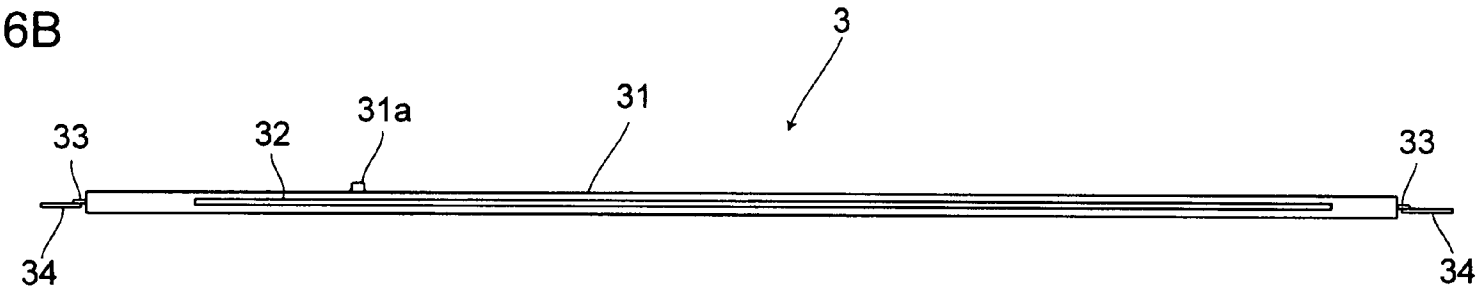
FIG. 6B is an elevation view of the second heater.
Figure 6C:
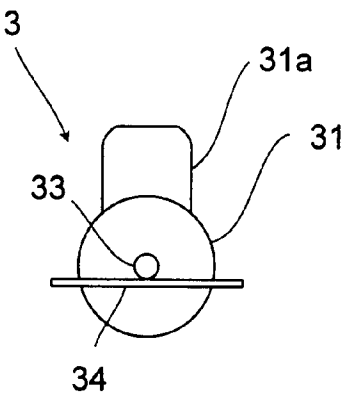
FIG. 6C is an enlarged side view of the second heater.

Next, a description will be given on the second heater 3. FIG. 5 is a perspective view of the second heater. FIG. 6A is a plan view of the second heater, FIG. 6B is an elevation view of the second heater, and FIG. 6C is an enlarged side view of the second heater. As shown in FIGS. 5, 6A, and 6B, the basic construction of the second heater 3 is identical to that of the first heater 2. In these figures, numeral 31 represents a silica glass tube, numeral 32 represents a filament, numeral 33 represents lead wires, and numeral 34 represents flat terminals, respectively corresponding to the components of the first heater 2 provided with the same names. The second heater 3 differs from the first heater 2 only in the following point. In the first heater 2, the flat terminals 24 are, as described above, respectively fitted to the protruding end portions of the lead wires 23 so as to be located on the same side as the tip portion 21*a* with respect to the diameter of the silica glass tube 21 (see FIG. 4C). On the contrary, in the second heater 3, the flat terminals 34 are, as shown in FIG. 6C, respectively fitted to the protruding end portions of the lead wires 33 so as to be located on the side opposite to the tip portion 31*a* with respect to the diameter of the silica glass tube 31 (arranged in the order of the flat terminals 34, the lead wires 33, and the tip portion 31*a* in the radial direction). Therefore, there is an inverse relationship in arrangement position between the flat terminals 24 of first heater 2 and the flat terminals 34 of the second heater 3.

Figure 7:
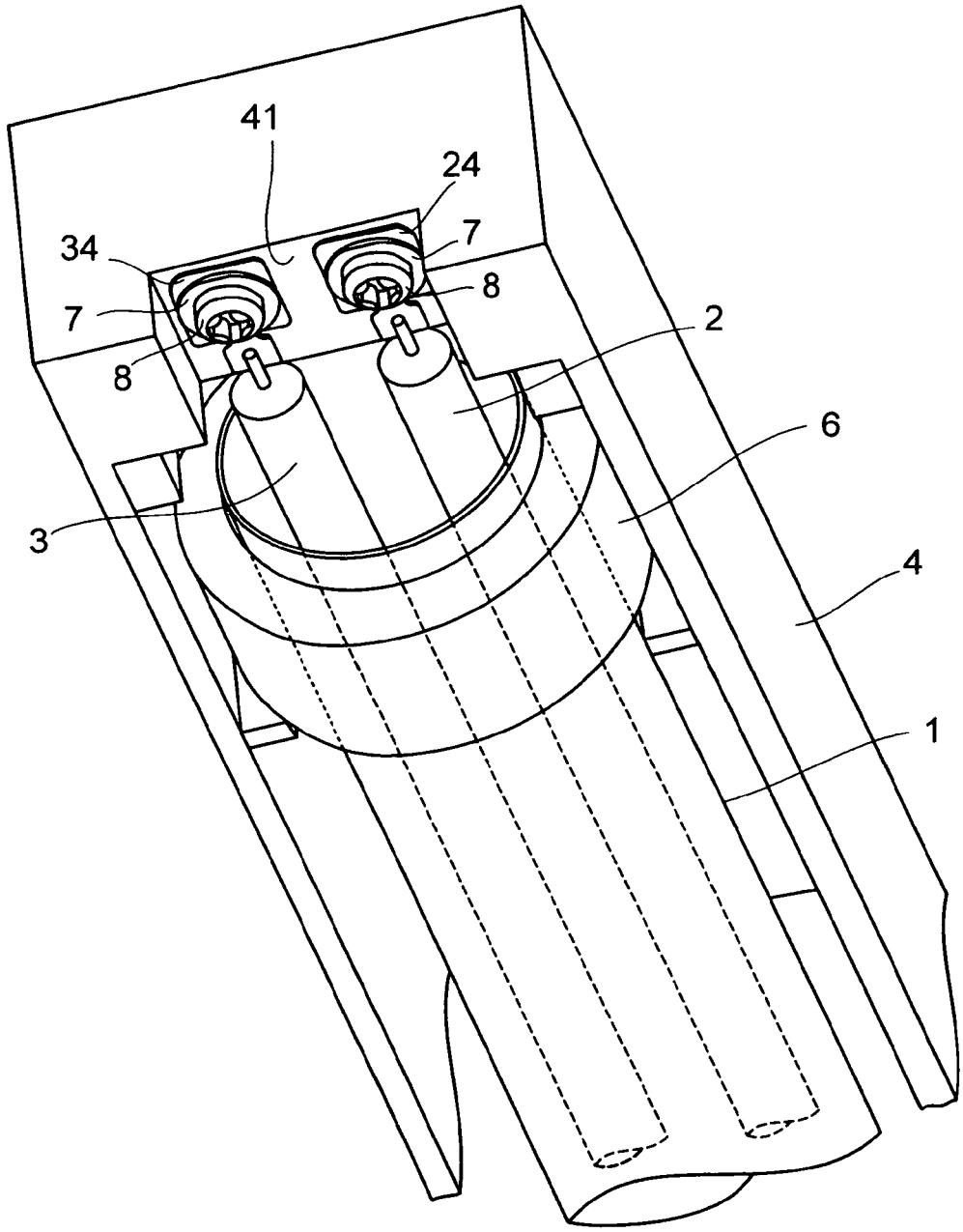
FIG. 7 is a partial perspective view showing a first embodiment of the fixing unit according to the invention.
Figure 8:
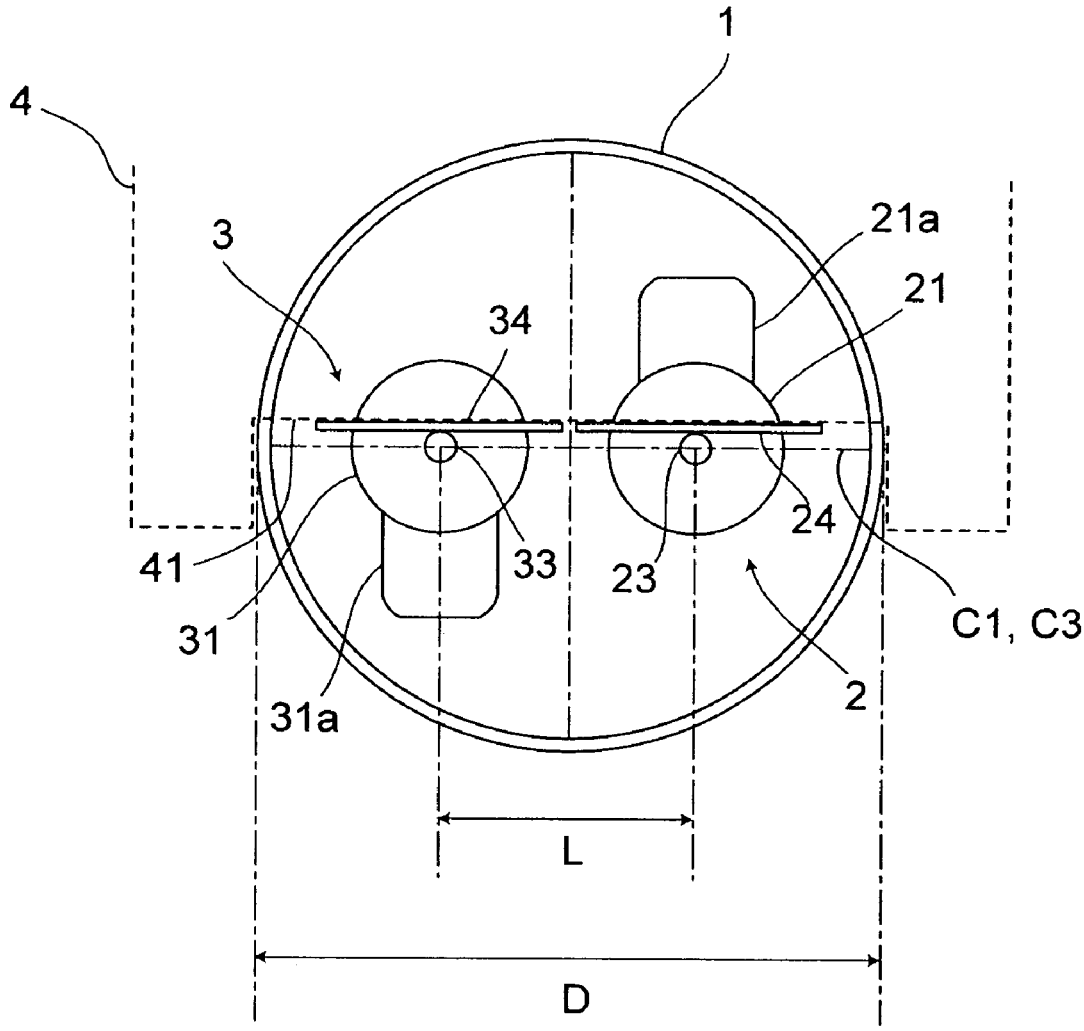
FIG. 8 is a side view showing the positional relationship between heaters and the heat roller in the first embodiment.

A detailed description will be given, with reference to FIGS. 7 and 8, on a first embodiment of the invention employing the first heater 2 and the second heater 3 constructed as described above. FIG. 7 is a partial perspective view showing the first embodiment of the fixing unit according to the invention. FIG. 8 is a side view showing the positional relationship between heaters and the heat roller in the first embodiment. As shown in FIG. 7, in both longitudinal side walls of the upper case 4 (only one end side is shown in FIG. 7), concave portions are formed on the open side thereof so as to be notched into a U shape. On this concave portion, a fitting surface 41 is formed. Then, after inserted through the heat roller 1 rotatably supported by the sliding bearings 6 fixed on the both end portions of the upper case 4, the first and second heaters 2 and 3 are respectively fitted through the holes 24*a* and 34*a* (see FIGS. 4 and 6) of the flat terminals 24 and 34 to the fitting surface 41 of the upper case 4 with, for example, screws 8 via washers 7. In this fitting, as shown in FIG. 8, it is advisable that the both heaters 2 and 3 be arranged with centers thereof located on a center line C3 of the heat roller 1.

Figure 22:
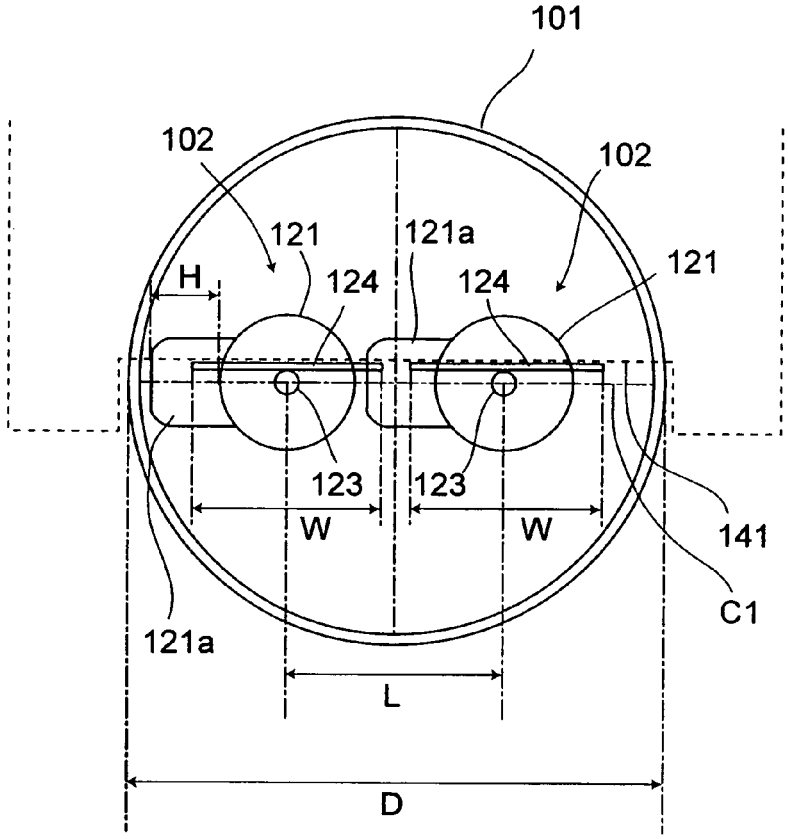
FIG. 22 PRIOR ART
FIG. 22 is a side view showing the positional relationship between heaters and a heat roller in a conventional fixing unit.

Consequently, as shown in FIG. 8, the tip portions 21*a* and 31*a* of the first and second heaters, respectively, are oriented directly opposite to each other with respect to a connection line C1 connecting the centers of the silica glass tubes 21 and 31; that is, they are located in point-symmetry with respect to the center of the heat roller 1 on the same plane. This not only achieves orderly arrangement of the two heaters 2 and 3 in the heat roller 1, but also, shortens the distance L between their centers and also reduces the risk of their interference with the inner wall of the heat roller 1, compared to a conventional example (see FIG. 22) in which the tip portions 121*a* of the two heaters are in line-symmetry with respect to the connection line C1 connecting the centers of the silica glass tubes 121. Accordingly, an outer diameter D of the heat roller can be reduced. Compared to a conventional example (see FIG. 23) in which the tip portions 121*a* of the two heaters are in line-symmetry with respect to a straight line C2 orthogonal to the connection line C1 connecting the centers of the silica glass tubes 121, the risk of breakage upon installation of the heaters can be eliminated.

Second Embodiment

Figure 9:
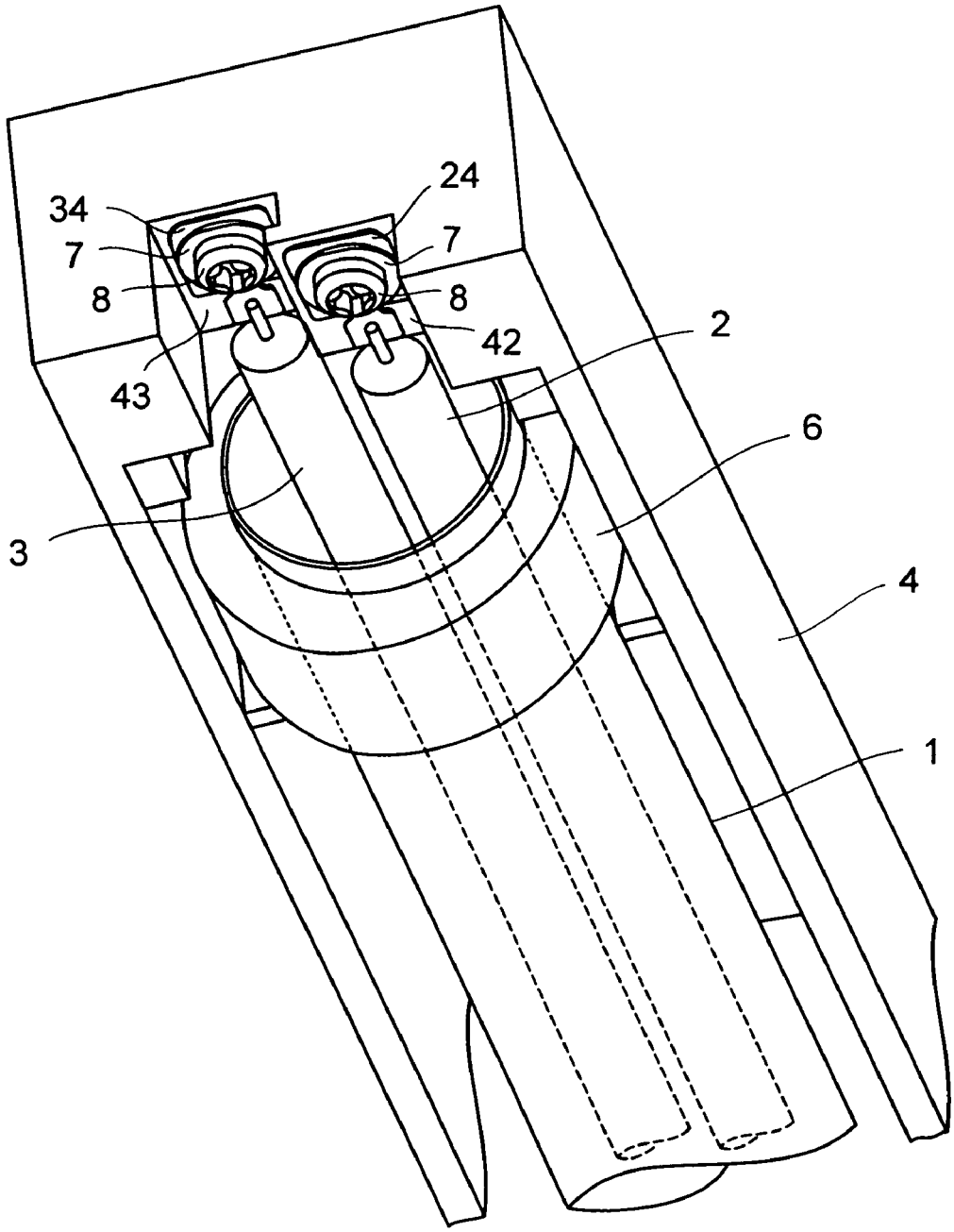
FIG. 9 is a partial perspective view showing a second embodiment of the fixing unit according to the invention.
Figure 10:
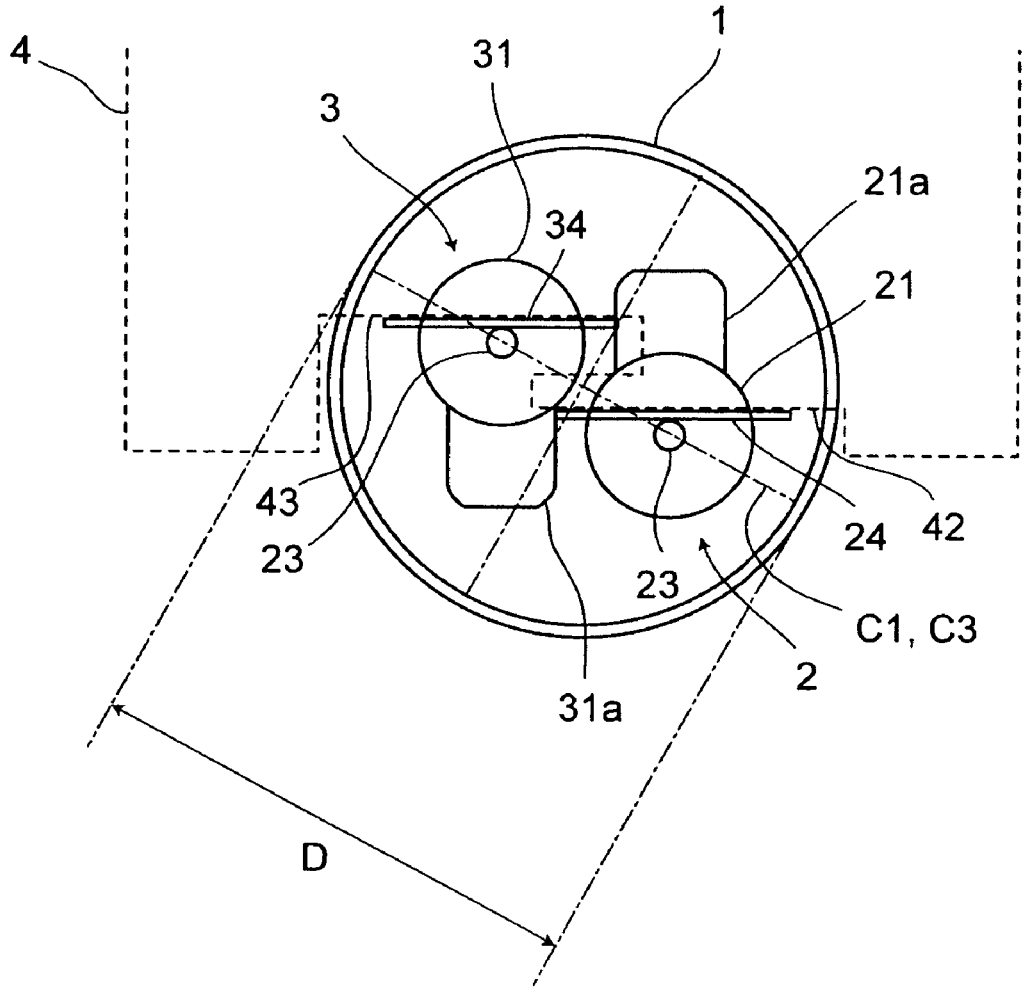
FIG. 10 is a side view showing the positional relationship between heaters and the heat roller in the second embodiment.

Next, a description will be given on, with reference to FIGS. 9 and 10, the second embodiment of the invention employing the first and second heaters 2 and 3 constructed in the same manner as in the first embodiment. FIG. 9 is a partial perspective view showing the second embodiment of the fixing unit according to the invention. FIG. 10 is a side view showing the positional relationship between the heaters and the heat roller in the second embodiment. As shown in FIG. 9, in the both longitudinal end walls of the upper case 4 (only one end side is shown in FIG. 9), concave portions are formed on the open side thereof so as to be notched into a substantially U shape. On this concave portion, a first and second fitting surfaces 42 and 43 are formed stepwise. The second fitting surface 43 is formed at a deeper depth than the first fitting surface 42 as viewed from the both longitudinal side walls of the upper case 4, and the boundary wall between the two surfaces is formed stepwise so that the two surfaces partially overlap with each other in the direction perpendicular thereto. After inserted through the heat roller 1 rotatably supported by the sliding bearings 6 fixed on the both end portions of the upper case 4, the first and second heaters 2 and 3 are respectively fitted through the holes 24*a* and 34*a* (see FIGS. 4 and 6) of the flat terminals 24 and 34 to the first and second fitting surfaces 42 and 43 of the upper case 4 with, for example, screws 8 via washers 7. In this fitting, as shown in FIG. 10, it is advisable that the both heaters 2 and 3 be arranged with centers thereof located on the center line C3 of the heat roller 1.

Consequently, as shown in FIG. 10 and as is the case with the first embodiment, the tip portions 21*a* and 31*a* of the first and second heaters 2 and 3 are oriented opposite to each other with respect to the connection line C1 connecting the centers of the glass tubes 21 and 31. As a result, the connection line C1 tilts at a predetermined angle with respect to the first and second fitting surfaces 42 and 43. In addition, the tip portions 21*a* and 31*a* are so arranged as to tilt toward the silica glass tubes 31 and 21 adjacent thereto, respectively.

Thus, as shown in FIG. 10, compared to the heater arrangement shown in the first embodiment (see FIG. 8), more compact storage of the first and second heaters 2 and 3 in the heat roller 1 is permitted, thus permitting further downsizing of the diameter D of the heat roller.

The first and second embodiments described above are implemented by use of the first and second heaters 2 and 3 having mutually different constructions. Hereinafter, a third and a fourth embodiments will be described which provide the same effect by use of heaters having only either one of the constructions.

Third Embodiment

Figure 11:
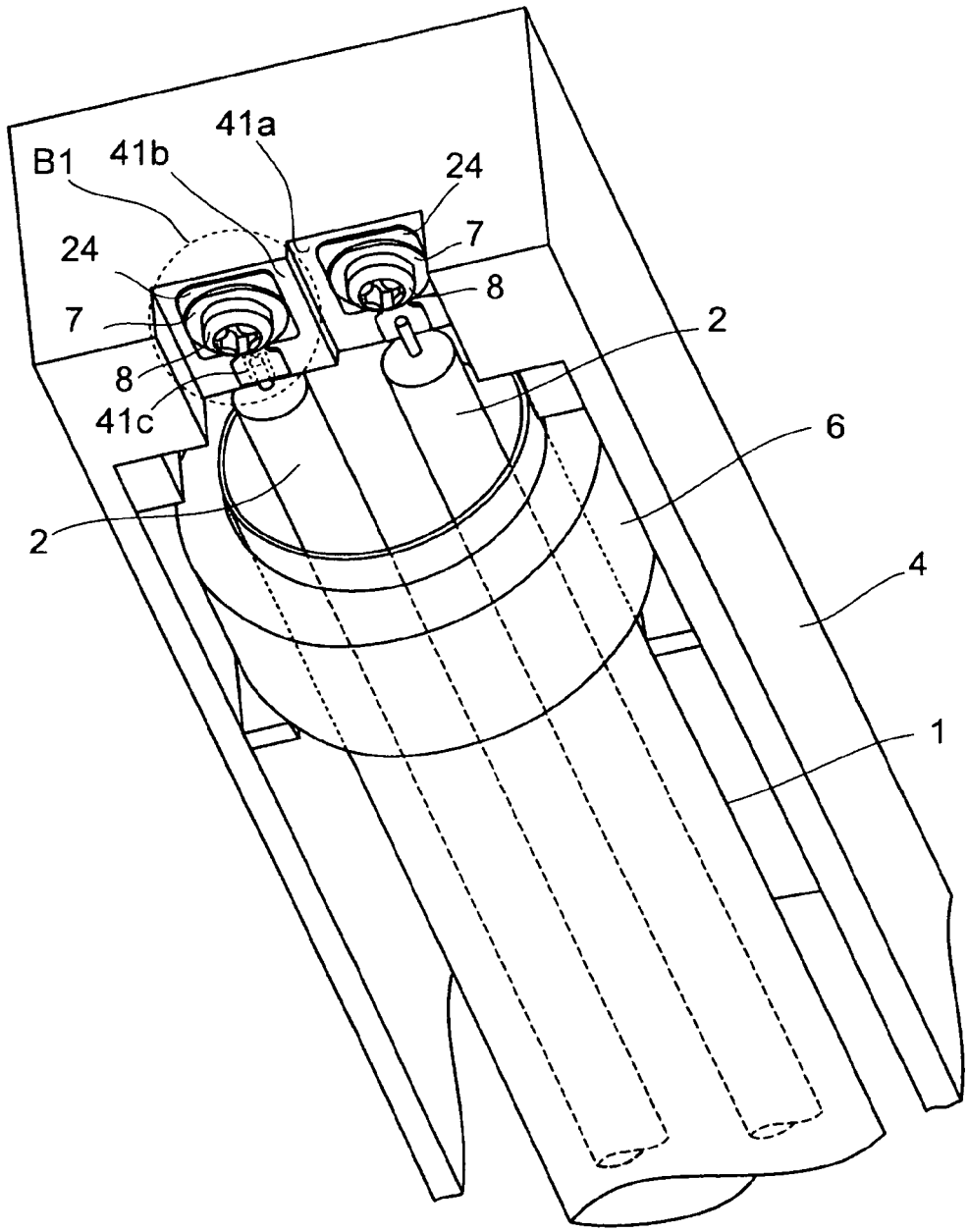
FIG. 11 is a partial perspective view showing the third embodiment of the fixing unit according to the invention.
Figure 12A:
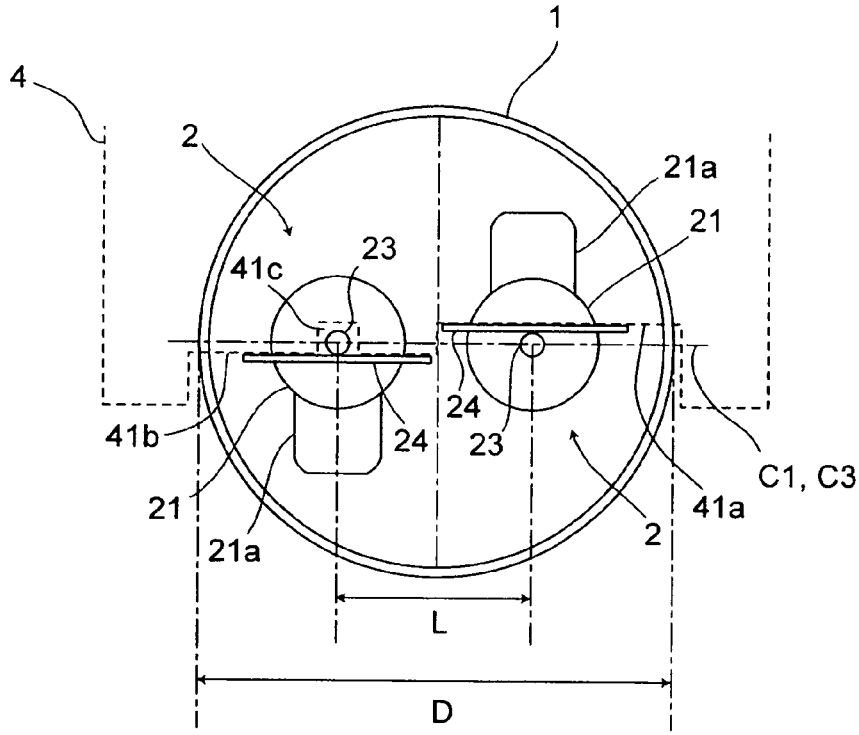
FIG. 12A is a side view showing the positional relationship between heaters and the heat roller in third embodiment.

The third embodiment of the invention will be described. FIG. 11 is a partial perspective view showing the third embodiment of the fixing unit according to the present invention. FIG. 12A is a side view showing the positional relationship between heaters and the heat roller in the third embodiment. The components, the same as those described referring to FIGS. 7 and 8 are provided with the same reference numerals and thus omitted from the description. In one example of this embodiment, two of the heaters 2 having the same construction as the conventional one shown in FIG. 3 are used. For convenience, in FIGS. 11 and 12A, the heater shown on the right is referred to as a first heater 2, and the heater shown on the left is referred to as a second heater 2.

The differences shown in FIG. 11 from FIG. 7 showing the first embodiment are: the use of the second heater 2 instead of the second heater 3; and the shape at a stepped portion B1 of concave portions formed on the open side of the two longitudinal end walls of the upper case 4 (only one end side is shown in FIG. 11) being notched into a U shape. On this concave portion, a first and a second fitting surfaces 41*a* and 41*b* are formed stepwise. The depth of the first fitting surface 41*a* is equal to that of the first fitting surface 42 of FIG. 7. In order to locate the centers of the first and second heaters 2 and 2 on the center line C3 of the heat roller 1, as viewed from the both longitudinal end walls of the upper case 4, the second fitting surface 41*b* is formed at a shallower depth than the first fitting surface 41*a*. Moreover, the second fitting surface 41*b* is formed with a notch 41*c* for storing the lead wire 23 of the second heater 2.

With this construction, as shown in FIG. 12A, the tip portions 21*a* and 21*a* of the first and second heaters 2 and 2, respectively, are oriented directly opposite to each other with respect to the connection line C1 connecting the centers of the silica glass tubes 21 and 21; that is, they are located in point-symmetry with respect to the center of the heat roller 1 on the same plane. This provides the same effect as achieved by the first embodiment and permits the heaters 2 having the same construction as the conventional one to be used as a first and a second heaters, thus contributing to component cost reduction.

Figure 12B:
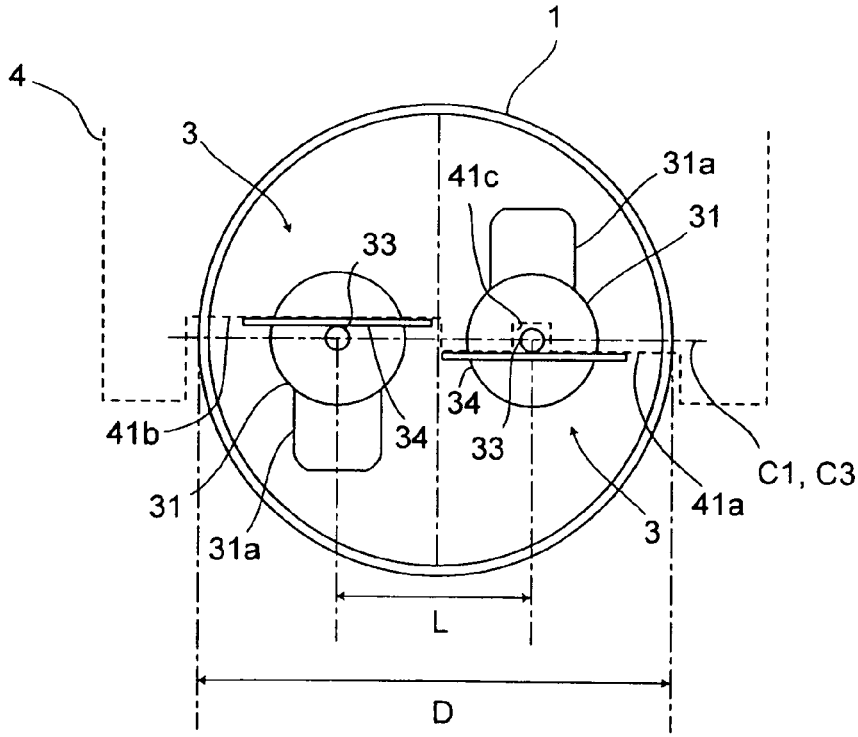
FIG. 12B is a side view showing another positional relationship between heaters and the heat roller in the third embodiment.

The third embodiment described above refers to an example where two heaters 2 having the same construction as the conventional one are used. Next, with reference to FIG. 12B, a brief description will be given on a case where it is required to use two of the heaters 3 having construction opposite to the conventional one. FIG. 12B is a side view showing another positional relationship between heaters and the heat roller in the third embodiment. The components, the same as those described referring to FIG. 12A are provided with the same reference numerals and thus omitted from the description. For convenience, in FIG. 12B, the heater shown on the right is referred to as a first heater 3, and the heater shown on the left is referred to as a second heater 3.

When the first and second heaters 3 and 3 are used, the comparison between FIGS. 12A and 12B shows that the depths of the first and second fitting surfaces 41*a* and 41*b* are reversed as viewed from the longitudinal both end walls of the upper case 4. Moreover, the notch 41*c* for storing the lead wire 33 of the first heater 3 is formed on the first fitting surface 41*a*. Even in this manner, the same arrangement as that of the first and second heaters 2 and 2 of the third embodiment shown in FIG. 12A can be achieved.

Fourth Embodiment

Figure 13:
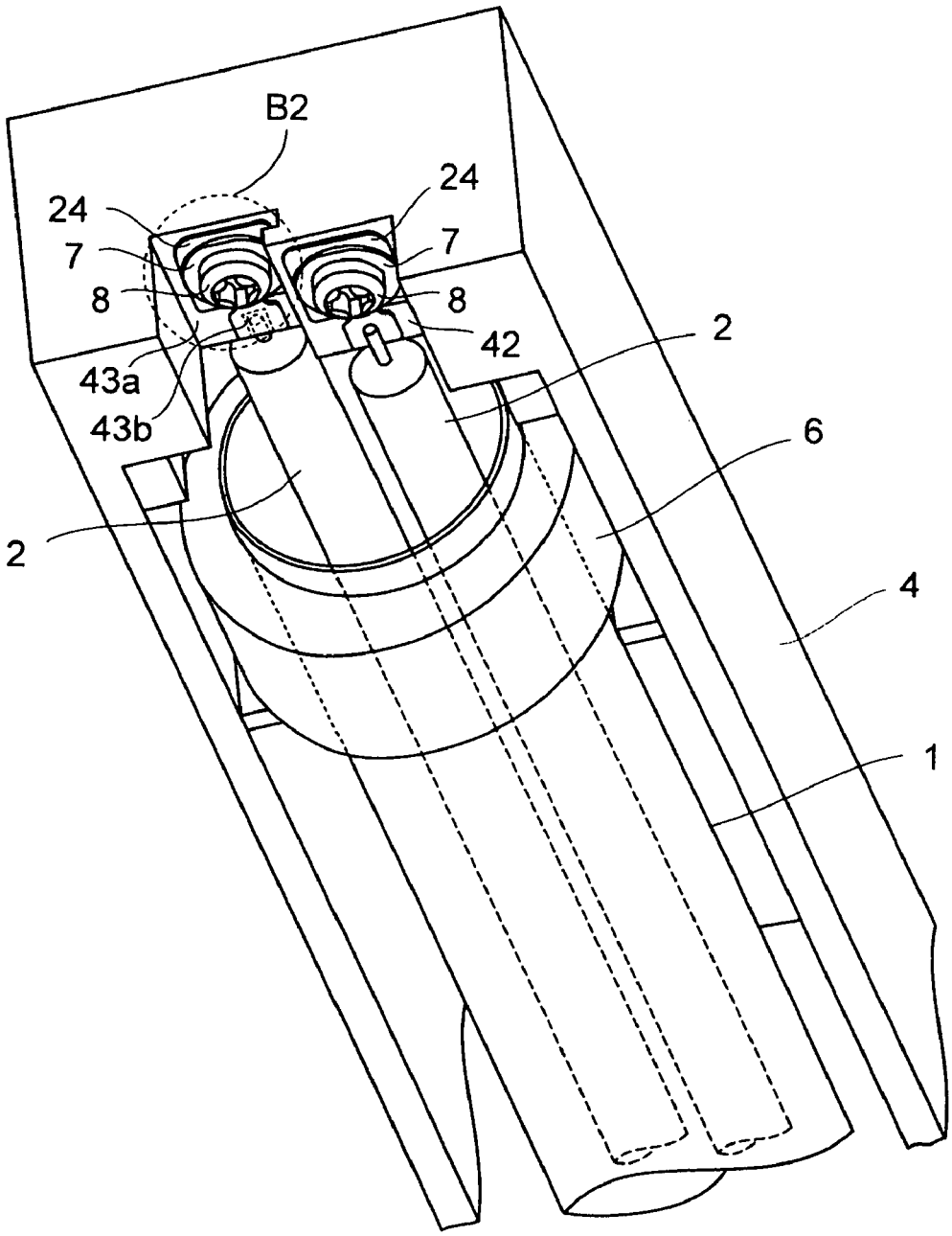
FIG. 13 is a partial perspective view showing a fourth embodiment of the fixing unit according to the invention.
Figure 14A:
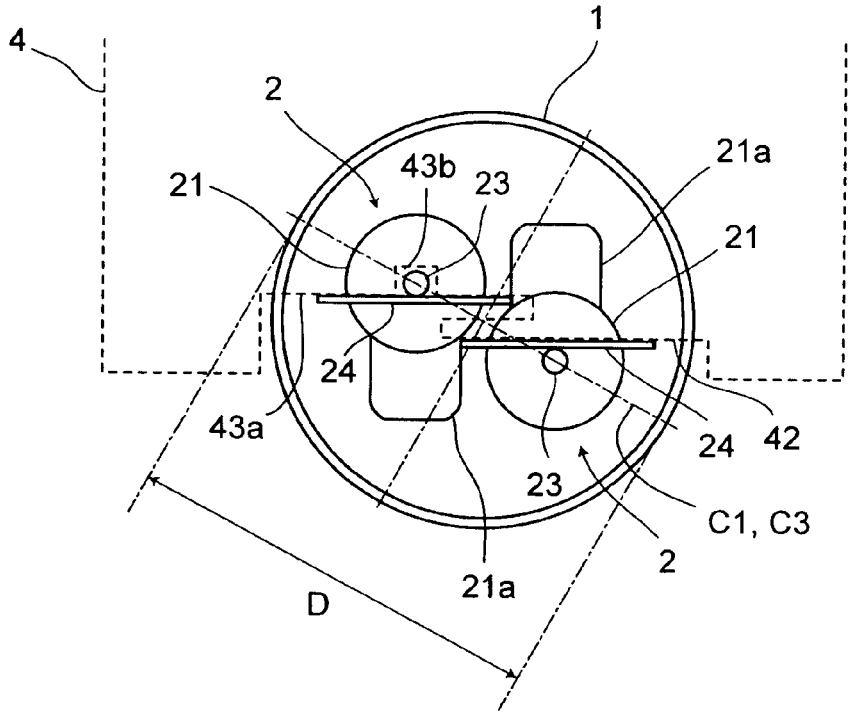
FIG. 14A is a side view showing the positional relationship between heaters and a heat roller in the fourth embodiment.

The fourth embodiment of the invention will be described. FIG. 13 is a partial perspective view showing the fourth embodiment of the fixing unit according to the present invention. FIG. 14A is a side view showing the positional relationship between heaters and the heat roller in the fourth embodiment. The components, the same as those described referring to FIGS. 9 and 10 are provided with the same reference numerals and thus omitted from the description. In this embodiment, as in the third embodiment, two of the heaters 2 having the same construction as the conventional one shown in FIG. 3 are used. For convenience, in FIGS. 13 and 14A, the heater shown on the right is referred to as a first heater 2, and the heater shown on the left is referred to as a second heater 2.

The differences shown in FIG. 13 from FIG. 9 showing the second embodiment are: the use of the second heater 2 instead of the second heater 3; and the shape at a stepped portion B2 of concave portions formed on the open side of the two longitudinal end walls of the upper case 4 (only one end side is shown in FIG. 13) being notched into a U shape. On this concave portion, a first and a second fitting surface 42 and 43*a* are formed stepwise. The depth of the first fitting surface 42 is equal to that of the first fitting surface 42 of FIG. 9. In order to locate the centers of the first and second heaters 2 and 2 on the center line C3 of the heat roller 1, as viewed from the both longitudinal end walls of the upper case 4, the second fitting surface 43*a* is formed at a deeper depth than the first fitting surface 42, but at a shallower depth than the second fitting surface 43 shown in the second embodiment of FIG. 10. Moreover, the second fitting surface 43*a* is formed with a notch 43*b* for storing the lead wire 23 of the second heater 2.

With this construction, as shown in FIG. 14A and as is the case with the second embodiment, the tip portions 21*a* and 21*a* of the first and second heaters 2 and 2, respectively, are oriented opposite to each other with respect to the connection line C1 connecting the centers of the silica glass tubes 21 and 21. In addition, the tip portions 21*a* and 21*a* are arranged so as to tilt toward the silica glass tubes 21 and 21 adjacent thereto, respectively. This provides the same effect as achieved by the second embodiment and permits the heaters 2 having the same construction as the conventional one to be used as the first and second heaters, thus contributing to component cost reduction.

Figure 14B:
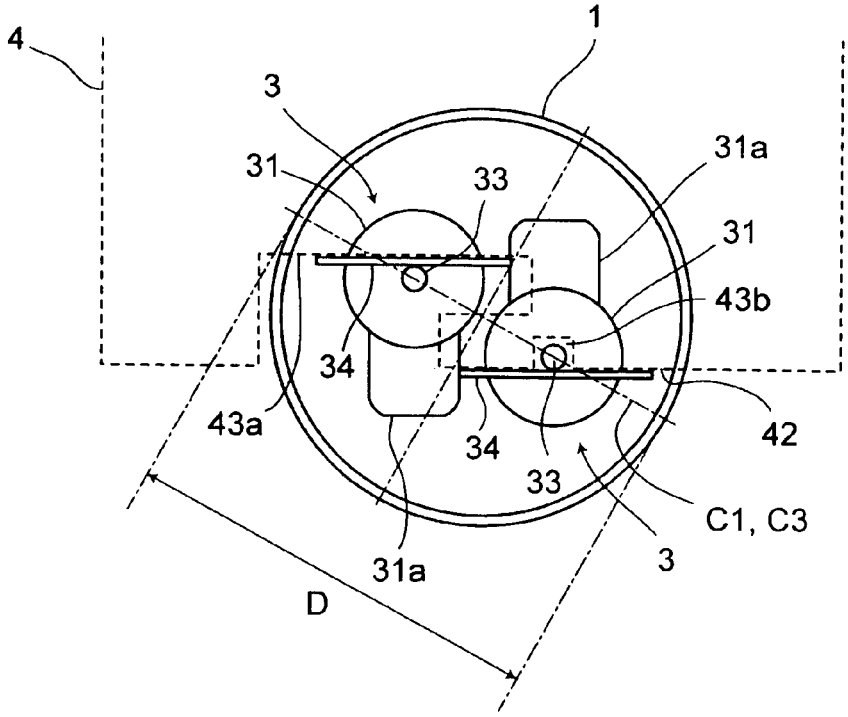
FIG. 14B is a side view showing another positional relationship between heaters and the heat roller in the fourth embodiment.

The fourth embodiment described above refers to an example where the two heaters 2 having the same construction as the conventional one are used. Next, with reference to FIG. 14B, a brief description will be given on a case where it is required to use two of the heaters 3 having construction opposite to the conventional one. FIG. 14B is a side view showing another positional relationship between the heaters and the heat roller in the fourth embodiment. The components, the same as those described referring to FIG. 14A are provided with the same reference numerals and thus omitted from the description. For convenience, in FIG. 14B, the heater shown on the right is referred to as a first heater 3, and the heater shown on the left is referred to as a second heater 3.

When the first and second heaters 3 and 3 are used, the comparison between FIGS. 14A and 14B shows that the depths of the first and second fitting surfaces 42 and 43*a* differ as viewed from the longitudinal both end walls of the upper case 4. More specifically, in the example shown in FIG. 14B, the level difference between the first and second fitting surfaces 42 and 43*a* becomes larger. Moreover, a notch 43*b* for storing the lead wire 33 of the first heater 3 is formed on the first fitting surface 42. Even in this manner, the same arrangement as that of the first and second heaters 2 and 2 of the fourth embodiment shown in FIG. 14A can be achieved.

Therefore, the application of the fourth embodiment permits more compact storage of the first and second heaters in the heat roller 1, compared to the arrangements shown in the first and third embodiments described above (see FIGS. 8, 12A, and 12B), thus permitting further downsizing of the diameter D of the heat roller. As a result, the same results as achieved by the second embodiment are provided.

The heater arrangements shown in the second and fourth embodiments in particular are possibly applied to a fixing unit for a color copier. For the color copier, the heat roller is required to rotate more stably; thus, a rolling bearing is more suitable than a sliding bearing described above.

When a rolling bearing is employed for rotatably supporting the heat roller, considering that a rolling bearing typically has a larger thickness than a sliding bearing, the pressure contact between the heat roller and the pressure roller cannot be ensured by employing a waistless heat roller as described above.

Figure 15:
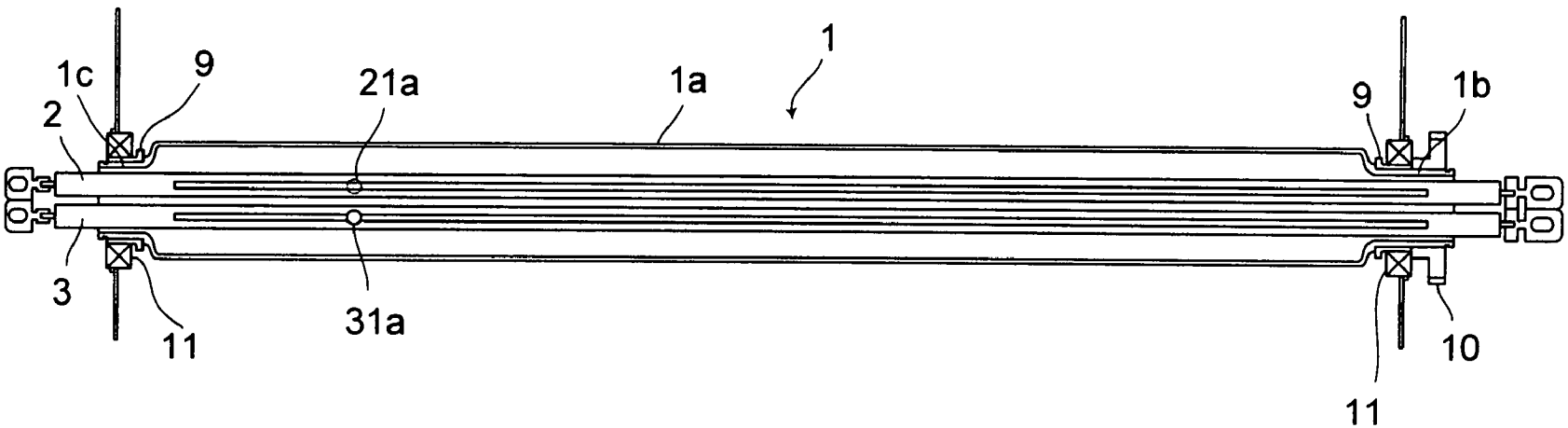
FIG. 15 is a lateral sectional view of an example of application of the second or forth embodiment to a heat roller having both ends thereof drawn.

Conventionally adopted as a heat roller for use in a color copier, as shown in FIG. 15, is the one having, on both ends thereof, shaft portions 1*b* and 1*c* that are formed with a smaller diameter by drawing a cylindrical metal material. Then by disposing rolling bearings 11 respectively on the periphery of heat insulating resin bearings 9 fitted on the outer periphery of the shaft portions 1*b* and 1*c* respectively at the both ends of the heat roller 1, the thickness of the rolling bearing 11 is offset by the drawn portion of the heat roller, which can ensure the pressure contact between the heat roller 1 and the pressure roller 13.

On the other hand, with such a heat roller, the inner diameter of the both end shaft portions can be as small as 10 and several mm if a compact roller having a small diameter is used. With the conventional heater fitting structure, it is difficult to store in the heat roller both of two heaters having a tube diameter of 6 mm or so. Thus, the adoption of the heater arrangement described in the second or fourth embodiment permits arrangement of two heaters with some room even in a compact heater roller having a small diameter in which these two heaters conventionally could not be stored or could be stored but only tightly. This is extremely effective for fixing units of space-saving type color copiers.

The first to fourth embodiments of the inventions have been described above based on one example of the fixing unit shown in FIG. 1. However, the invention is applicable not only to this single example of a fixing unit, but also to various forms of fixing units. Next, with reference to FIGS. 16 to 21, schematic descriptions will be given on other examples of a fixing unit to which the invention is applicable. The components, the same as those described referring to FIG. 1 are provided with the same reference numerals and thus omitted from the description. In FIGS. 16 to 21, a first and second heaters disposed in a heat roller 1 are provided with numerals 2 and 3, respectively, as used in the first and second embodiments, but they should be replaced with numerals 2, 2 and 3, 3, respectively if the third and fourth embodiments are used.

Figure 16:
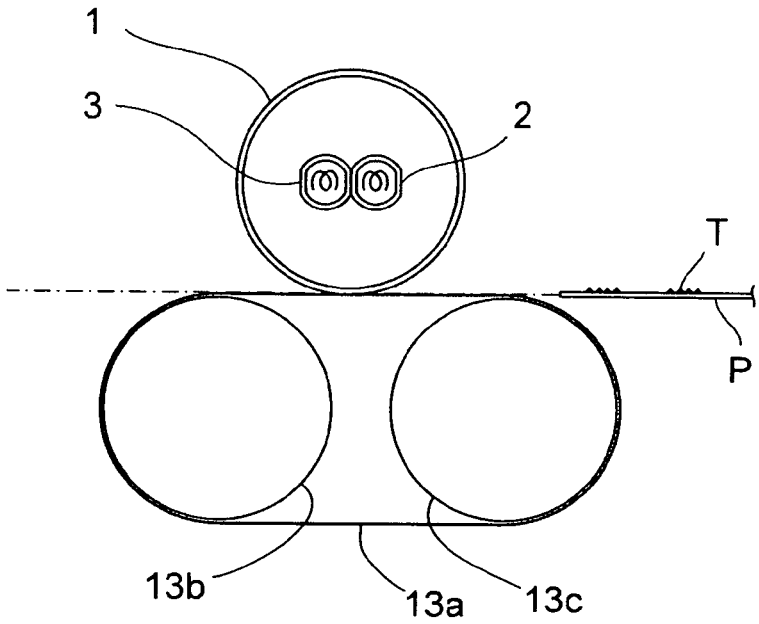
FIG. 16 is a schematic side view showing the outline construction of main parts of another example of a fixing unit to which the invention is applicable.

FIG. 16 is a schematic side view showing the outline construction of main parts of another example of a fixing unit to which the invention is applicable. A heat roller 1 is used for supplying heat for fixing and also used as a fixing roller for fixing a toner T on recording paper P. In addition to the heat roller 1, the fixing unit is roughly composed of: an endless pressure belt 13*a* for bringing the recording paper P, from the rear surface thereof, into pressure contact with the heat roller 1 to thereby support it; and two guide rollers 13*b* and 13*c* for rotatably supporting the pressure belt 13*a* at both ends thereof.

Figure 17:
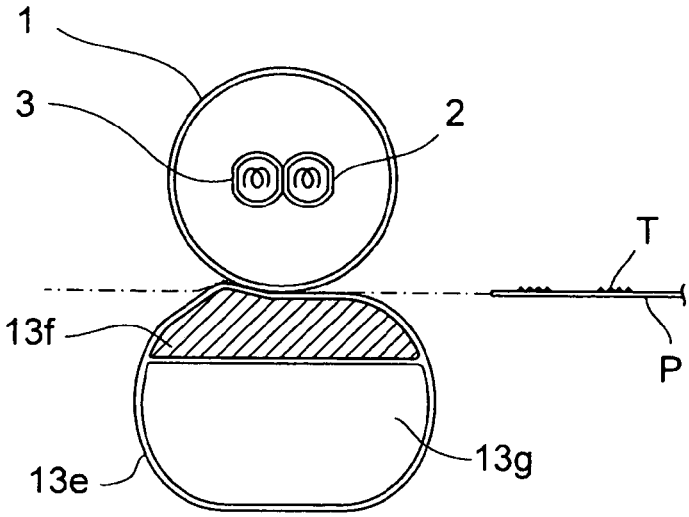
FIG. 17 is a schematic side view showing the outline construction of main parts of still another example of a fixing unit to which the invention is applicable.

FIG. 17 is a schematic side view showing the outline construction of main parts of still another example of a fixing unit to which the invention is applicable. A heat roller 1 is used for supplying heat for fixing and also used as a fixing roller for fixing a toner T on recording paper P. In addition to the heat roller 1, the fixing unit is roughly composed of: an endless pressure belt 13*e* for bringing the recording paper P, from the rear surface thereof, into pressure contact with the heat roller 1 to thereby support it; an inner side support member 13*f* for supporting the inner side of the pressure belt 13*e* and bringing the recording paper P, from the rear surface thereof, into pressure contact with the heat roller 1 to thereby support it: and an inner side support member 13*g* for supporting the rotation of the pressure belt 13*e*.

Figure 18:
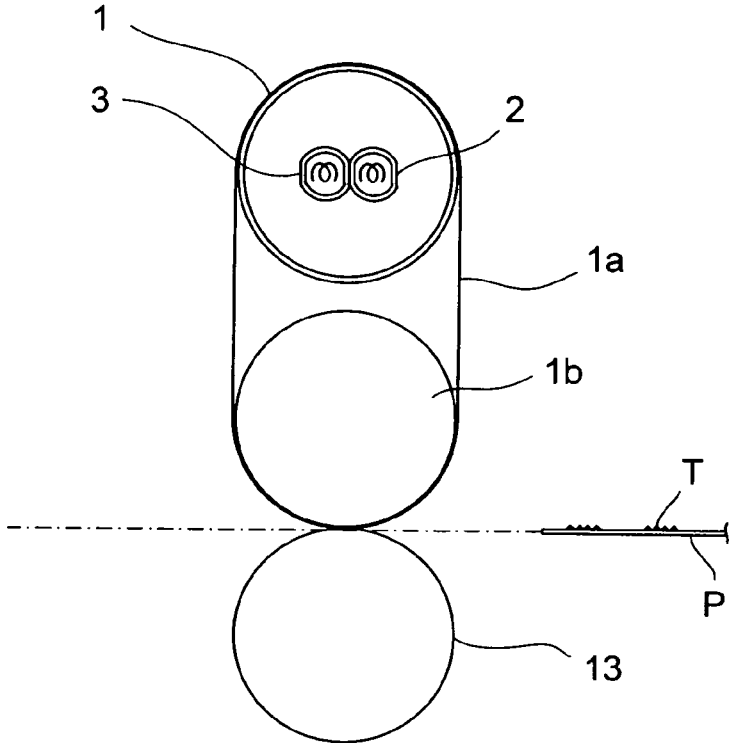
FIG. 18 is a schematic side view showing the outline construction of main parts of still another example of a fixing unit to which the invention is applicable.

FIG. 18 is a schematic side view showing the outline construction of main parts of still another example of a fixing unit to which the invention is applicable. In the fixing unit in this example, heat for fixing is supplied by a heat roller 1 and conducted to a fixing roller 1*b* through an endless heat conductive belt 1*a* that is wound at one end around the heat roller 1 and at the other end around the fixing roller 1*b*. The fixing roller 1*b* supplies heat stored therein and heat conducted through the heat conductive belt 1*a* from the rear surface of the heat conductive belt 1*a* to thereby fix a toner T on recording paper P. A pressure roller 13 brings the recording paper P, from the rear surface thereof, into pressure contact with the heat conductive belt 1*a* to thereby support it.

Figure 19:
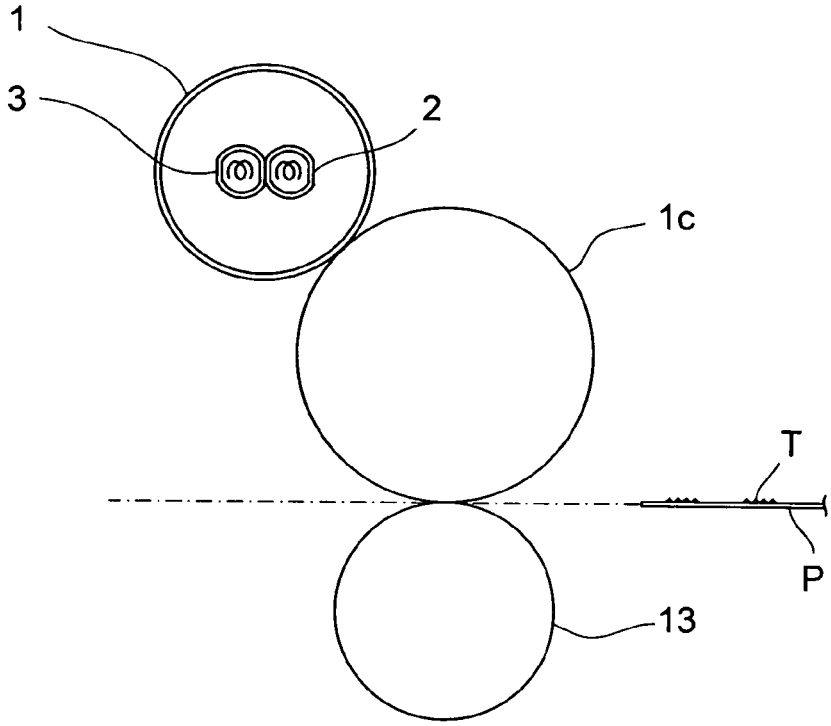
FIG. 19 is a schematic side view showing the outline construction of main parts of still another example of a fixing unit to which the invention is applicable.

FIG. 19 is a schematic side view showing the outline construction of main parts of still another example of a fixing unit to which the invention is applicable. In the fixing unit in this example, heat for fixing is supplied by a heat roller 1 and conducted to a fixing roller 1*c* that rotates in contact with the heat roller 1. The fixing roller 1*c* utilizes stored heat and conducted heat to fix a toner T on recording paper P. A pressure roller 13 brings the recording paper P, from the rear surface thereof, into pressure contact with the fixing roller 1*c* to thereby support it.

Figure 20:
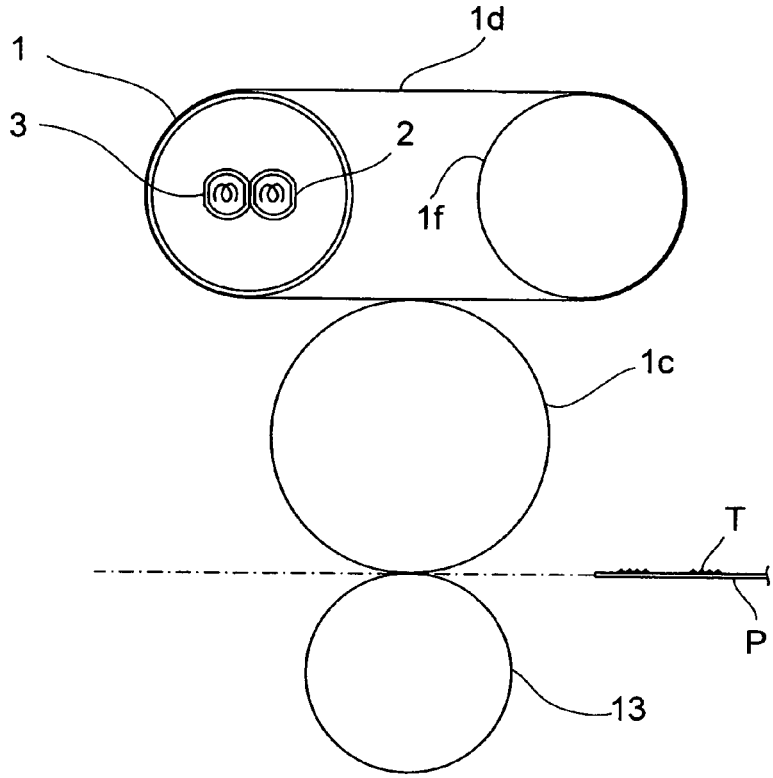
FIG. 20 is a schematic side view showing the outline construction of main parts of still another example of a fixing unit to which the invention is applicable.

FIG. 20 is a schematic side view showing the outline construction of main parts of still another example of a fixing unit to which the invention is applicable. In the fixing unit in this example, heat for fixing operation is supplied by a heat roller 1 and conducted to a fixing roller 1*c* through an endless heat conductive belt 1*d* that is wound at one end around the heat roller 1 and at the other end around an idle roller 1*f*. The fixing roller 1*c* utilizes stored heat and conducted heat to fix a toner T on recording paper P. A pressure roller 13 brings the recording paper P, from the rear surface thereof, into pressure contact with the fixing roller 1*c* to thereby support it.

Figure 21:
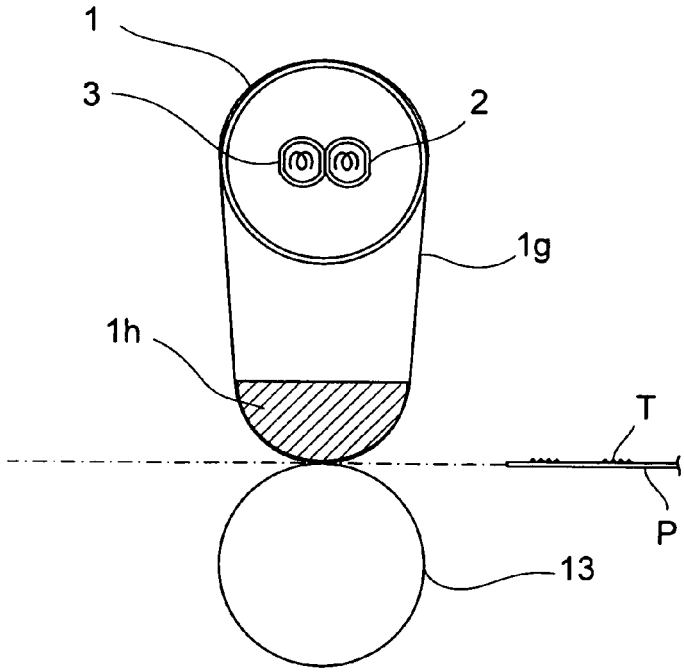
FIG. 21 is a schematic side view showing the outline construction of main parts of still another example of a fixing unit to which the invention is applicable.

FIG. 21 is a schematic side view showing the outline construction of main parts of still another example of a fixing unit to which the invention is applicable. In the fixing unit in this example, heat for fixing is supplied by a heat roller 1 and conducted to an endless heat conductive fixing belt 1*g* that is wound at one end around the heat roller 1 and at the other end around a support member 1*h*. The fixing belt 1*g* utilizes conducted heat to fix a toner T on recording paper P. The pressure roller 13 brings the recording paper P, from the rear surface thereof, into pressure contact with the fixing belt 1*g* to thereby support it.

When a large amount of heat is required for fixing, an additional heater may be arranged in the pressure roller 13 described referring to FIG. 1 together with the heat roller 1. In this case, it is obvious that the present invention is applicable to a case where two heaters are arranged.

The examples of a fixing unit to which the invention is applicable have been described above. It should be understood that application of the invention is not limited to these examples, and thus the invention is universally applicable to rollers having two tubular heaters arranged therein with two tip portions.

According to the present invention as described above, the tip portions of the two tubular heaters are oriented directly opposite to each other with respect to the connection line connecting the centers of the tubular heaters; that is, they are located in point-symmetry with respect to the center of the roller on the same plane. This not only achieves orderly arrangement of the tubular heaters in the roller, but also, compared to a conventional example (see FIG. 22) in which the tip portions of the two tubular heaters are in line-symmetry with respect to the connection line connecting the centers of the tubular heaters, shortens the distance between these centers. Accordingly, the diameter of the roller can be reduced. Compared to a conventional example (see FIG. 23) in which the tip portions of the two tubular heaters are in line-symmetry with respect to a straight line orthogonal to the connection line connecting the centers of the tubular heaters, fitting operation can be achieved with less occurrence of tubular heater breakage.

Further, the arrangement of the tip portions so that they respectively tilt toward the tubular heaters adjacent thereto permits more compact storage of the tubular heaters in the roller, thus permitting further downsizing of the diameter of the roller.

What is claimed is:

1. A fixing unit comprising, a casing;

a heat roller that is rotatably supported and that supplies heat for fixing; and a tubular heater that is disposed in parallel in the heat roller along an axis thereof, the tubular heater comprising a lead wire having a protruding end portion protruding outwardly from an axial end portion thereof and a flat terminal having one face thereof connected and fixed to the protruding end portion, wherein a fitting surface for fixing the flat terminal is formed in the casing, the fitting surface is arranged to be flat in an area excluding an area in which the protruding end portion is disposed and is provided with a clearance for storing the protruding end portion, and the flat terminal is fixed to the fitting surface with said one face facing the fitting surface.

2. The fixing unit according to claim 1, wherein the protruding end portion of the lead wire and the flat terminal are connected and fixed together by soldering.

3. The fixing unit according to claim 1, wherein the flat terminal is fixed to the fitting surface with a screw.

4. The fixing unit according to claim 1, wherein the heat roller is a fixing roller that fixes a toner on recording paper by making direct contact with a recording surface of the recording paper.

5. The fixing unit according to claim 1, wherein the heat roller is a pressure roller that makes direct contact with a surface opposite to a recording surface of recording paper.

6. The fixing unit according to claim 1, wherein the heat roller supplies heat, via a heat conductive belt that is endless and rotary, to a fixing roller that fixes a toner on recording paper by making direct contact with a recording surface of the recording paper.

7. The fixing unit according to claim 1, wherein the heat roller supplies heat to a fixing roller, that fixes a toner on recording paper by making direct contact with a recording surface of the recording paper, by rotating and making contact with the fixing roller.

8. The fixing unit according to claim 1, wherein the heat roller supplies heat to an endless fixing belt, that fixes a toner on recording paper by making direct contact with a recording surface of the recording paper, by rotating and making contact with the endless fixing belt.

9. An image forming apparatus comprising the fixing unit according to claim 1.

10. A fixing unit comprising, a casing;

a heat roller that is rotatably supported and that supplies heat for fixing; and first and second tubular heaters that are disposed in parallel in the heat roller along an axis thereof, the first and second tubular heaters each comprising a lead wire having a protruding end portion protruding outwardly from an axial end portion thereof and a flat terminal having one face thereof connected and fixed to the protruding end portion, wherein a first fitting surface for fixing the flat terminal of the first tubular heater and a second fitting surface for fixing the flat terminal of the second tubular heater are formed in the casing, the first fitting surface is arranged to be flat at least in an area in which the protruding end portion of the first tubular heater is disposed, the second fitting surface is arranged to be flat in an area excluding an area in which the protruding end portion of the second tubular heater is disposed and is provided with a clearance for storing the protruding end potion of the second tubular heater, the flat terminal of the first tubular heater is fixed to the first fitting surface with a face opposite to said one face of the first tubular heater facing the first fitting surface, the flat terminal of the second tubular heater is fixed to the second fitting surface with said one face of the second tubular heater facing the second fitting surface, and the first fitting surface has a step difference relative to the second fitting surface.

* * * * *